US008911286B1

(12) United States Patent
Savigny

(10) Patent No.: US 8,911,286 B1
(45) Date of Patent: Dec. 16, 2014

(54) CONCENTRIC AIR DIFFUSER WITH AN ANGLED SUPPLY AIR FACE

(76) Inventor: Michael Lee Savigny, Sherrills Ford, NC (US)

( * ) Notice: Subject to any disclaimer, the term of this patent is extended or adjusted under 35 U.S.C. 154(b) by 593 days.

(21) Appl. No.: 12/978,792

(22) Filed: Dec. 27, 2010

Related U.S. Application Data

(60) Provisional application No. 61/292,249, filed on Jan. 5, 2010.

(51) Int. Cl.
*F24F 7/00* (2006.01)
*F24F 13/08* (2006.01)

(52) U.S. Cl.
USPC ..... 454/248; 454/237

(58) Field of Classification Search
USPC ..... 454/245, 248, 292, 296, 237, 243
See application file for complete search history.

(56) References Cited

U.S. PATENT DOCUMENTS 4,181,253 A * 1/1980 Barlow ..... 236/49.2
4,709,623 A * 12/1987 Roth et al. ..... 454/292
5,054,379 A * 10/1991 Sodec ..... 454/296
5,069,114 A * 12/1991 Sodec et al. ..... 454/297
5,076,152 A * 12/1991 Muller et al. ..... 454/245
5,318,474 A * 6/1994 Klassen et al. ..... 454/296
5,830,058 A * 11/1998 Røsjø ..... 454/187
5,844,148 A * 12/1998 Klein et al. ..... 73/863.82
6,206,778 B1 * 3/2001 Smith ..... 454/292
6,251,007 B1 * 6/2001 Smith ..... 454/292
6,260,375 B1 * 7/2001 Kuo ..... 62/407
6,264,551 B1 * 7/2001 Smith ..... 454/248
6,379,241 B1 * 4/2002 Kuo ..... 454/248
6,685,556 B1 * 2/2004 Bertin ..... 454/256
6,945,866 B2 * 9/2005 Demster ..... 454/248
7,241,217 B2 * 7/2007 Demster ..... 454/322
7,262,705 B2 * 8/2007 Back et al. ..... 340/628
7,297,050 B2 * 11/2007 Bridenne et al. ..... 454/187
7,645,188 B1 * 1/2010 Peerbolt ..... 454/296
2007/0131299 A1 * 6/2007 Kornbleet ..... 138/149
2008/0227382 A1 * 9/2008 Profeta et al. ..... 454/358
2009/0269572 A1 * 10/2009 Orologio ..... 428/316.6
2010/0071797 A1 * 3/2010 Jungers ..... 138/141

* cited by examiner

*Primary Examiner* — Steven B McAllister
*Assistant Examiner* — Jonathan Cotov
(74) *Attorney, Agent, or Firm* — Thomas M. Fisher

(57) ABSTRACT

Apparatus includes a four sided ceiling pass-through support structure and an angled air exchange structure wherein an air inlet portion is substantially co-planer with the ceiling and at least one air outlet portion is angled with respect to the air inlet portion at an angle other than 90 degrees.

10 Claims, 8 Drawing Sheets

CONCENTRIC AIR DIFFUSER WITH AN ANGLED SUPPLY AIR FACE

CROSS REFERENCE TO RELATED APPLICATIONS

This application claims the benefit of Provisional Patent Application Ser. No. 61/292,249 filed Jan. 5, 2010, titled CONCENTRIC AIR DIFFUSER WITH AN ANGLED SUPPLY AIR FACE which is hereby incorporated in its entirety.

BRIEF SUMMARY OF THE INVENTION

Figure 1:
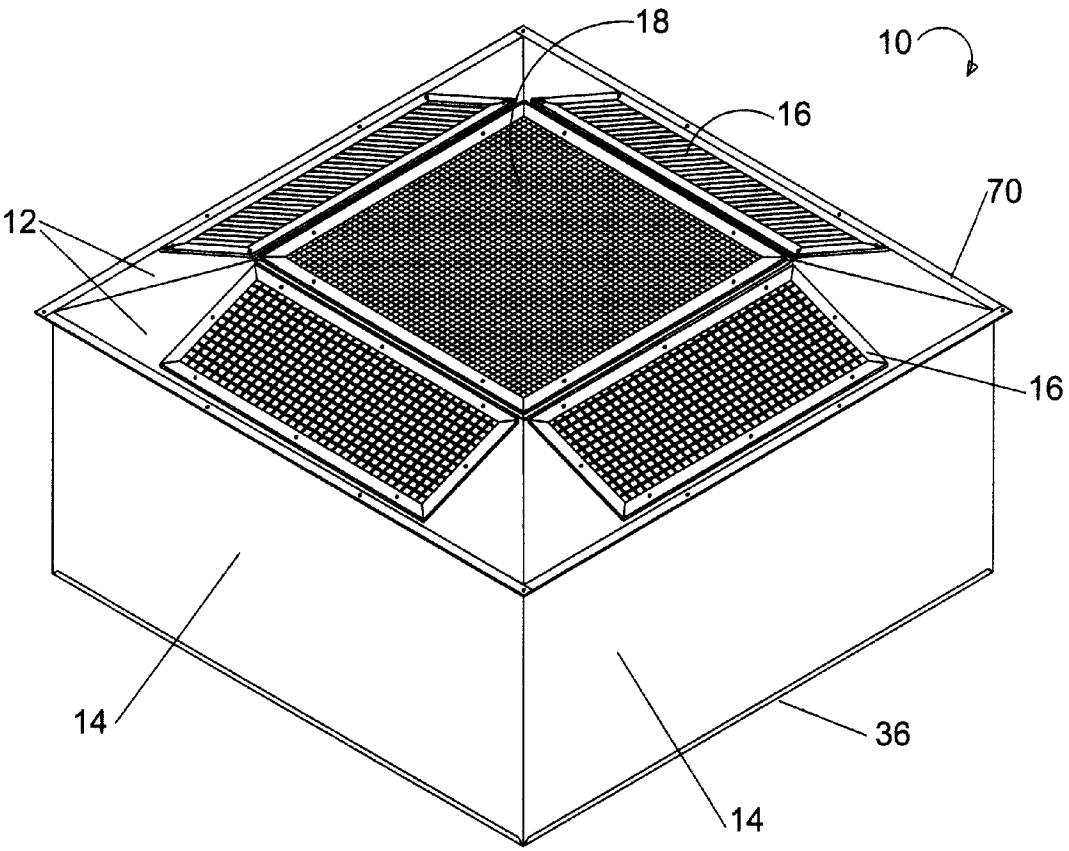
FIG. 1 is a perspective view of an exemplary embodiment of the invention.
Figure 3:
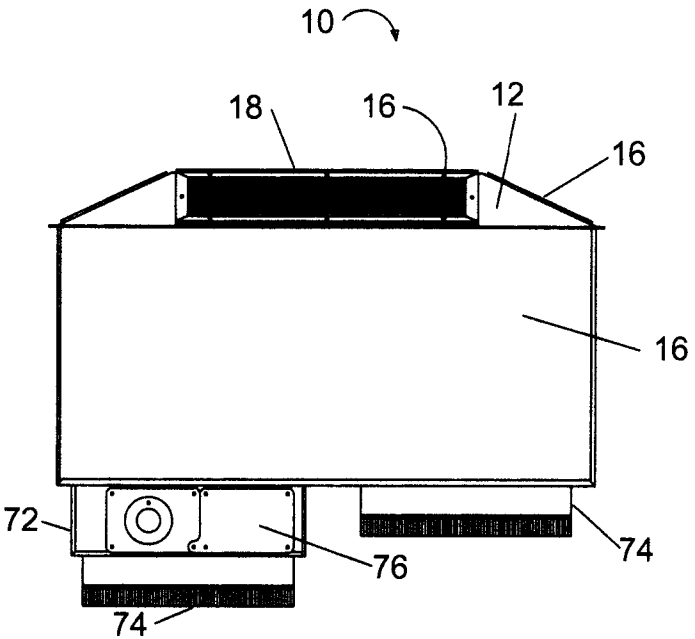
FIG. 3 is a side view of an exemplary embodiment of the invention shown in FIG. 1.
Figure 2:
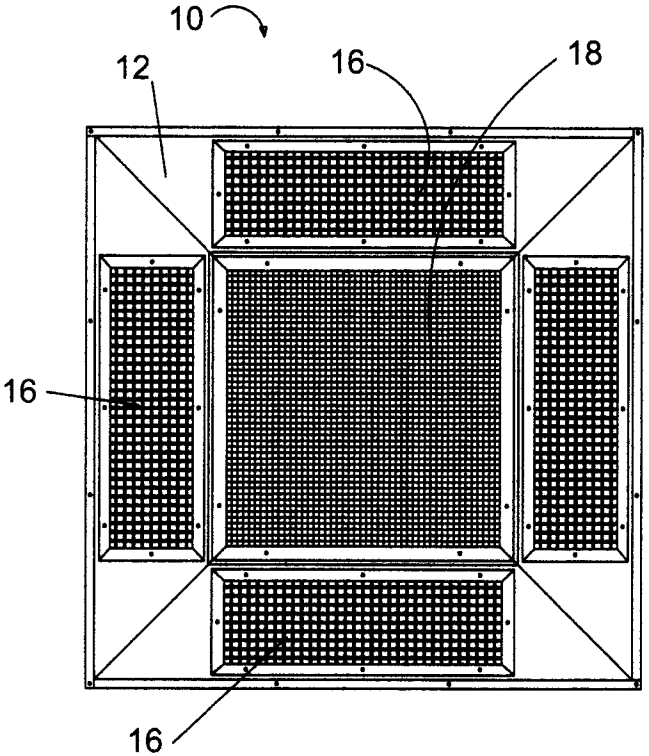
FIG. 2 is a top view of an exemplary embodiment of the invention shown in FIG. 1.

In one aspect, apparatus is provided that includes a four sided ceiling pass-through support structure and an angled air exchange structure wherein an air inlet portion is substantially co-planer with the ceiling and at least one air outlet portion is angled with respect to the air inlet portion at an angle other than 90 degrees.

In another respect, a method is provided that includes providing an inner surround structure that channels ingoing air of an air exchange system, providing an air diffuser, providing a smoke detector including a sampling tube, providing an outer surround structure that channels outgoing air of the air exchange system, and mounting the smoke detector to the diffuser such that a sampling tube of the detector extends into the inner surround structure and the sampling tube is accessible through a single access door in the inner surround structure.

In yet another aspect, apparatus is provided that includes a bidirectional airflow device configured to simultaneously direct both incoming air and outgoing air and one or more baffles placed inside the bidirectional airflow device, the baffles positioned and sized such that outgoing air is substantially balanced between a plurality of outgoing air diffusers.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention generally is a concentric air diffuser with an angled supply air face.

Typical concentric air diffusers can be flat faced and square drop box types. The instant concentric air diffuser can provide a less limited amount of face area and increased adjustability of throw for supply air to be delivered. With a larger face area, there are less restrictions, noise, and room for a pre-manufactured adjustable air throw device. The instant diffuser can have an angled face that can allow for a larger face area compared to a flush mount diffuser with a completely flat face. The instant diffuser also can allow for the use of off-the-shelf supply air diffusers with adjustable blades that allow for adjusting air flow distribution and balancing. The angled face can also be more cosmetically appealing than a drop box square type concentric air diffuser.

Typical devices can have a flat face with limited space for supply air dispersion. The flat face diffuser can also have limited or no adjustment to the supply air distribution. The drop box (square) concentric that is typically available may not blend into a ceiling as well as the instant angled face diffuser. The instant angled face diffuser may not project below the ceiling as much as other drop box concentric diffusers do.

Now referring to FIGS. 1-4, an exemplary embodiment of the instant device (10) comprises the following elements. A plurality of exterior sides (14) that can be made from, for example but not limited to, 24 gauge sheet metal. As is universally known, 24 gauge sheet metal is non permeable to air. As are other typical materials used for fabricating air handling devices such as air ducts (both hard and flexible) for example. The exterior sides (14) can be insulated with, for example, R-8 duct liner insulation that is glued and pinned. The exterior sides (14) can have four equal sides. The sides (14) can be bent up accordingly and locked together with, for example but not limited to a Pittsburgh lock. Instead of Pittsburgh locks, any known attachment methods such as Snap locks, or ⅛" rivets can be employed. The top (36) can also be constructed of, for example but not limited to, 24 gauge sheet metal. The top (36) can have round or rectangular inlets for the supply and return. A center return air straight duct (22) and a center return air duct transition (24) can be constructed of, for example but not limited to, 24 gauge sheet metal. A deflector can be positioned between the return air section and the supply air section and can be attached to the center return air straight duct (22) and sides (14). A center return air grill (18) can use, for example but not limited to, a pre-fabricated aluminum egg crate grille. The four supply air diffusers (16) can be pre-manufactured by a diffuser manufacturer that sells grills and diffusers. The supply air diffusers are off the shelf items, not specifically manufactured for the instant device (10). The supply air diffusers can be diffusers with adjustable air deflectors that can be adjusted to balance outgoing air flow. Alternatively as better explained below, the supply air diffusers can be prefabricated adjustable diffusers where to achieve a substantially balanced air flow, a plurality of baffles are employed. The round inlet holes (not shown) can use a 4" high round collar that can be fastened and sealed to the top (36) or smoke pan (72). A 2" high rectangular collar can be used in lieu of round collars if chosen. Two air diverters (78), can be installed in the supply air section of the concentric diffuser, opposite of each other, before the top (36) is installed.

The four sides (14) can be bent up to make the exterior shell. The four sides (14) can be run through a Pittsburgh lock machine and then locked together. The four face (12) pieces can be bent at approximately a 27 degree angle or at similar angles and secured together with ⅛ inch rivets. The sides (14) can be insulated with the exemplary R-8 duct liner that is secured with glue and pins.

The face (12) is then attached to the sides (14) using four trim pieces (70) with ⅛ inch rivets or a similar manner.

The center return air straight duct (22) can be fabricated and then connected to the face (12). This can be connected with ⅛ inch rivets or a similar manner. The center return air transition (24) can be fabricated and then connected to the center straight duct (22) with "S" cleats (86) and screws.

The two air diverters (78) can be fabricated, formed, and then installed in the supply air section of the device. This allows for interior air distribution around the rear side of the return air duct transition units (22, 24). The baffle (84) is fabricated and attached to the sides (14).

The top (36) can be placed on top after the side flanges are bent. The top (36) can have either round or rectangular inlets. The top (36) can be insulated with, for example, R-8 R value duct liner. The top (36) can be attached with rivets and sealed as well.

All face (12) seams can be caulked. The face can be typically painted white. The four supply air diffusers can be installed in the face (12) with screws as well as the inlet and outlet collars (74) can be installed in the top (36) with screws or tabs and then sealed with caulk.

The instant device is described as a complete supply and return air diffuser device for a fan powered heating, ventilating, and air-conditioning (HVAC) unit. However, if non-fan units exist currently or are later developed, then the benefits of the invention would accrue to such non-fan type units. When connected to a fan powered HVAC unit, the device can supply to and return air from a desired space. The device can supply a desired amount of air outward, away from the device through its four angled faces (12). The angled faces (12) sit below the existing ceiling if the device is installed in an area with a ceiling. The device may be designed to be installed in many different ceiling applications, including t-bar lay in types. The center of the device can take air in through the eggcrate center of the return air grill (18) and acts as the return air collector.

The design of the diffuser with the angled face area sets it apart from all other concentric diffusers. The angle is an angle different than 90 degrees. In some embodiments, the angle is between about 15 degrees and 40 degrees. It has been empirically determined that 25 degree angles and 27 degree angles are especially useful. The inlet collars can be round or rectangular, depending on the customer's application of round or rectangular duct work. The supply air diffusers mounted in the face can be interchangeable. The sizes can be changed to match the amount of air flow desired by the customer. The top (36) design allows the customer the option to install a duct-mounted smoke detector (76) having a smoke pan (72) and an access door (96) as well. The sheet metal construction makes the device durable, ensuring long life and safe transportation. A smoke pan (72) is positioned on the top (36) in either the return side, supply side, or both, depending on the customers choice.

In order to make an exemplary embodiment of the device, the sides (14) are cut from, for example, 24 gauge sheet metal from a pattern using a computer numerical control (CNC) plasma cutting machine. The sides (14) can also be made using a shear and ordinary sheet metal hand type snips. The face portions can be bent to the proper angle and the side portions can have the flange area bent on a sheet metal brake. The insulation can be cut with a knife to match the sides (14). The insulation can be then glued and pinned, using welded or sticky back pins. The face (12) portion can be cut from a pattern using a CNC plasma cutting machine. The face (12) portion can also be made using a shear, ordinary sheet metal hand snips, and a hand brake. The center return air grille, and the supply air diffusers can be purchased from a manufacturer. The size of each depends on the size of the instant device that is being built to match a desired air flow quantity. The center return air duct transition can be made from a pattern using a CNC plasma cutting machine or by a shear, hand snips and brake. The center return air duct transition can use a Pittsburgh lock or snap lock to join the seams. These seams can be created by a roll forming machine with the proper rolls to provide one of the desire locks used for assembling. The sides (14), face (12), and trim (70) can be held together using pop-rivets, and sealed with duct sealing compound or caulk. The supply air diffusers can be mounted in a pre-cut hole in the face to match the size of the supply air diffuser and can be held in place by sheet metal screws. The round inlet collars can be purchased from a manufacturer of duct work fittings. The rectangular collars can be made by using a shear and sheet metal hand brake.

Figure 4:
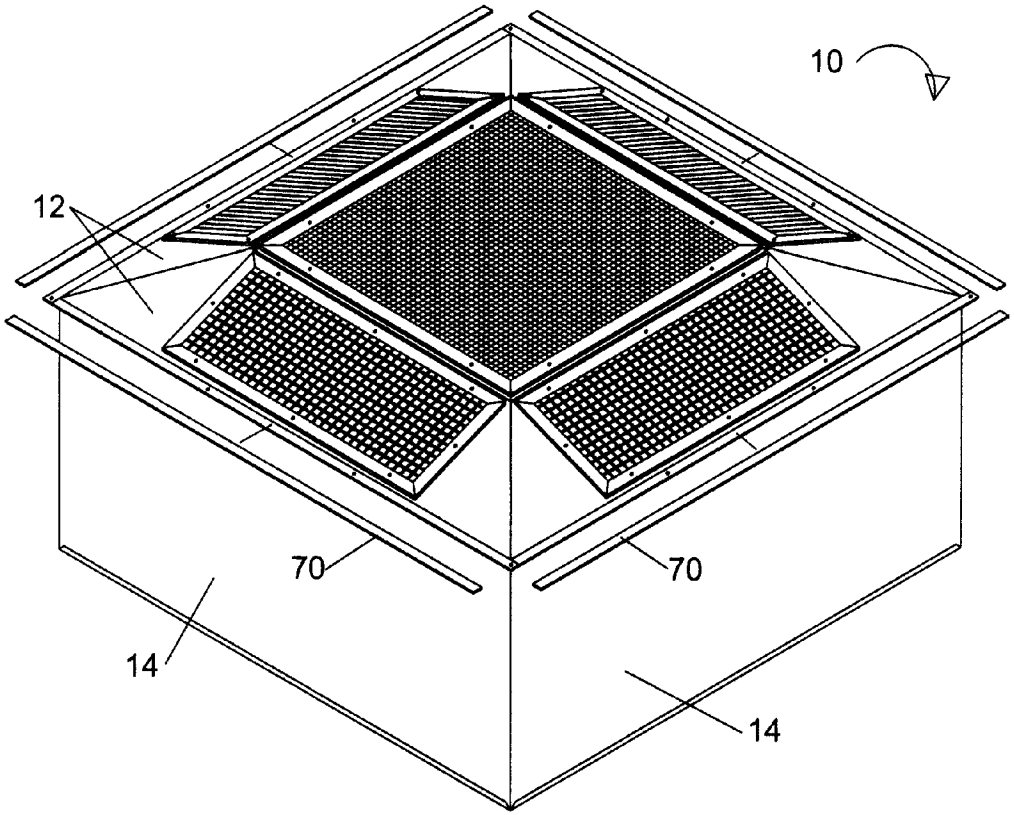
FIG. 4 is a perspective view of an exemplary embodiment of the invention.
Figure 5:
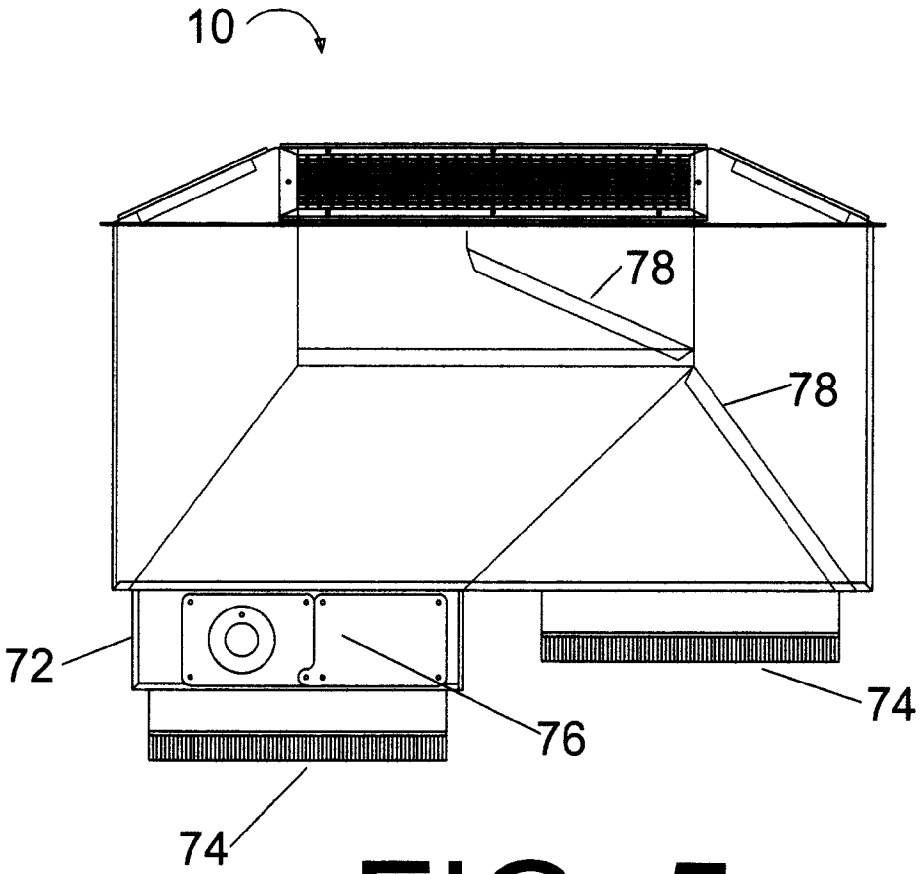
FIG. 5 is a side view of an exemplary embodiment of the invention shown in FIG. 4.
Figure 6:
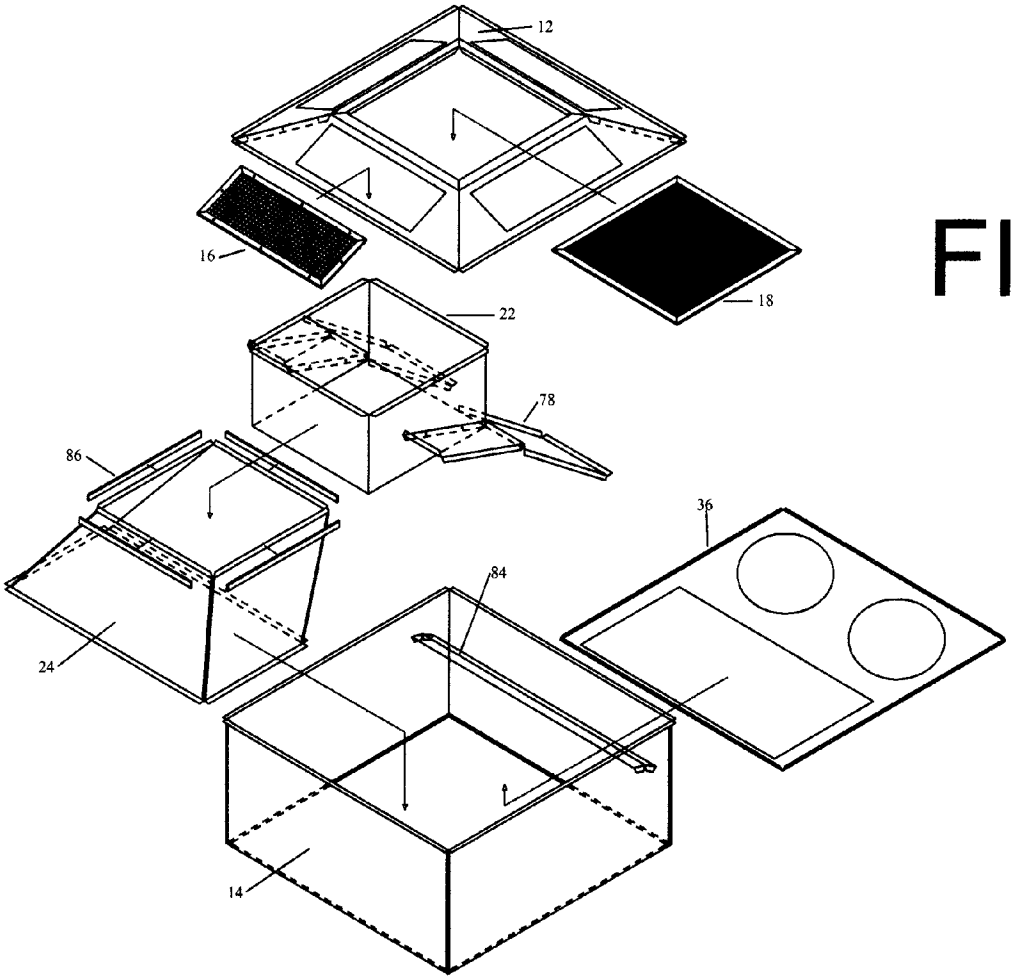
FIG. 6 is an exploded perspective view of an exemplary embodiment of the invention illustrating interior components.

FIG. 4 is a perspective view of an exemplary embodiment (10) of the invention including a plurality of upper mount members or faces (12), and a plurality of lower mount members or sides (14) showing the means of connecting and fastening with four trim (70) pieces. The trim (70) also facilitates mounting the device (10) in a ceiling, providing a means of trim. FIG. 5 is a side view of an exemplary embodiment (10) of the invention shown in FIG. 4. Device (10) can include a smoke pan (72) mounted in either the return air, supply air, or both, that includes a smoke detector (76), sampling tube (90), and access door (96) to test the air in flow for smoke. An air inlet collar (74) is provided as well as an air outlet collar (74). A plurality of baffles is provided (78,84) to balance supply air being delivered to the room in which device (10) is mounted. FIG. 6 is an exploded perspective view of an exemplary embodiment (10) of the invention illustrating interior components including component (84) which is a connector.

Figure 7A:
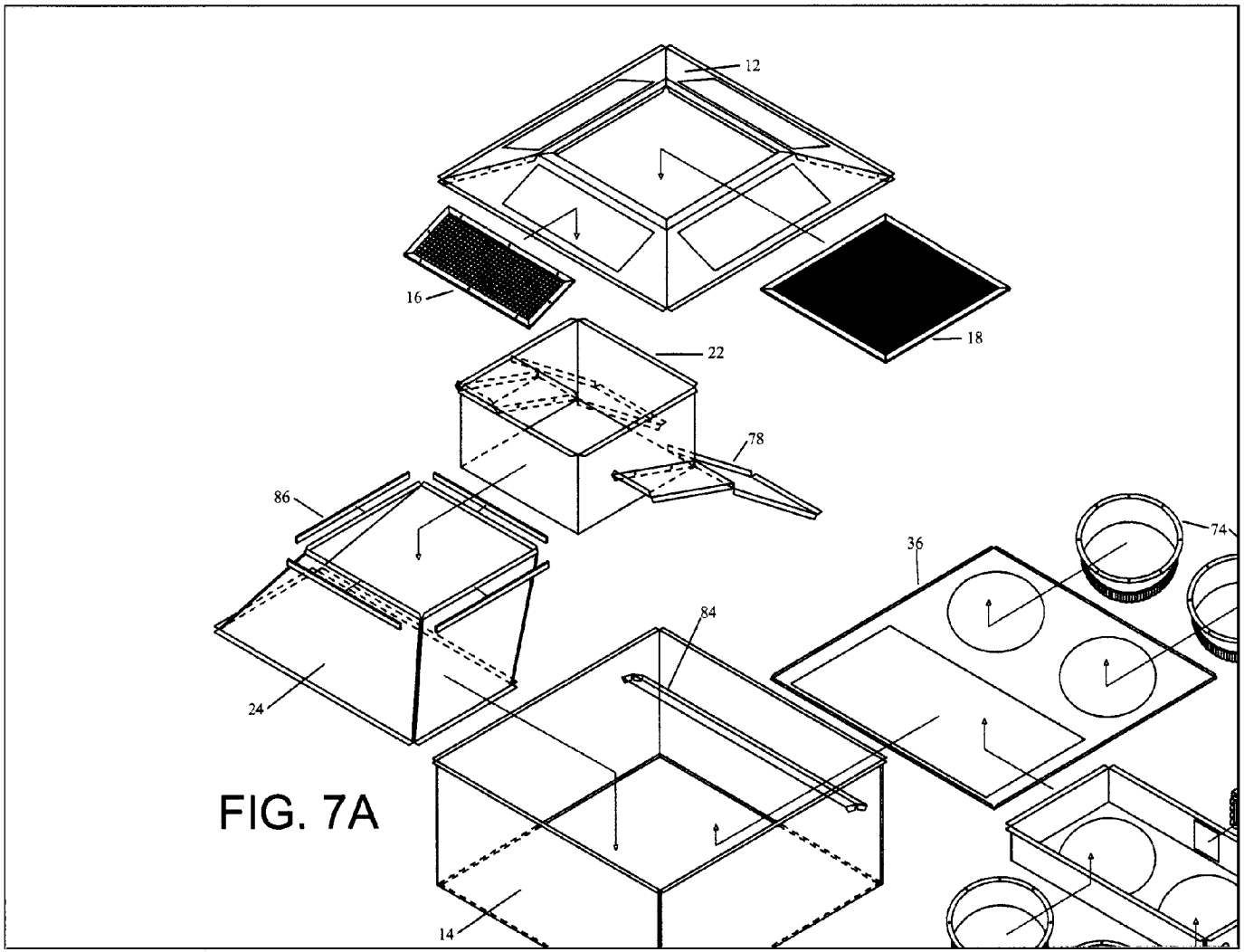
FIGS. 7A and 7B form an exploded perspective view of an exemplary embodiment the invention illustrating interior components.
Figure 7B:
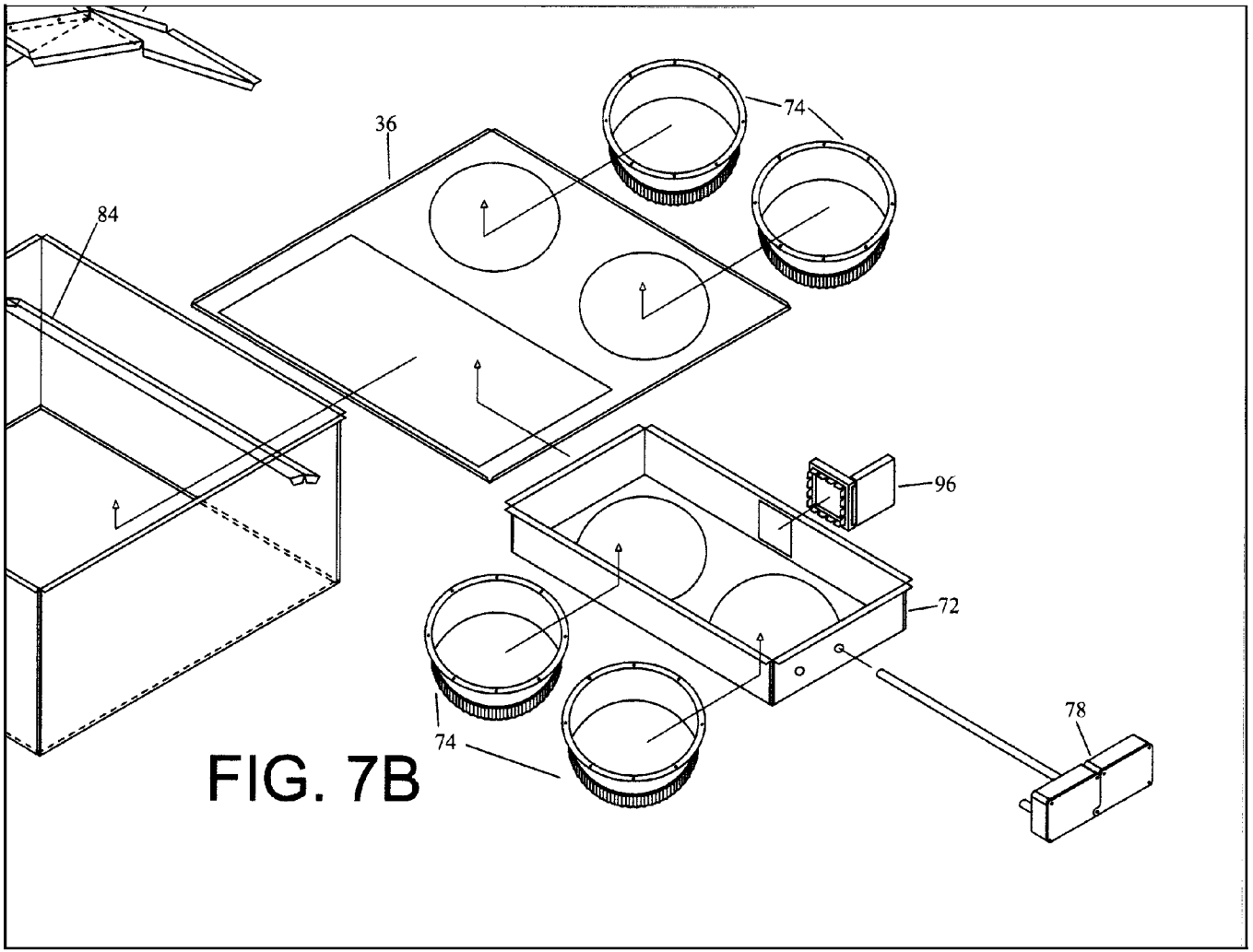

FIGS. 7A and 7B form an exploded perspective view of an exemplary embodiment the invention illustrating interior components including an air or smoke sampling tube (90). It should be noted that device (10) is an angled air exchange structure, and apparatus is bidirectional in that air flow is both supply air and return air. The instant device can be used in the air distribution of a fan forced HVAC unit. It can be directly connected with either flexible duct work or hard duct work to the supply air outlet and return air inlet of the HVAC fan unit. The instant device can be typically used in commercial and industrial applications.

In alternative embodiments, the angled face concentric diffuser can be made in multiple sizes to accommodate the desired amount of air flow quantities required.

Figure 8:
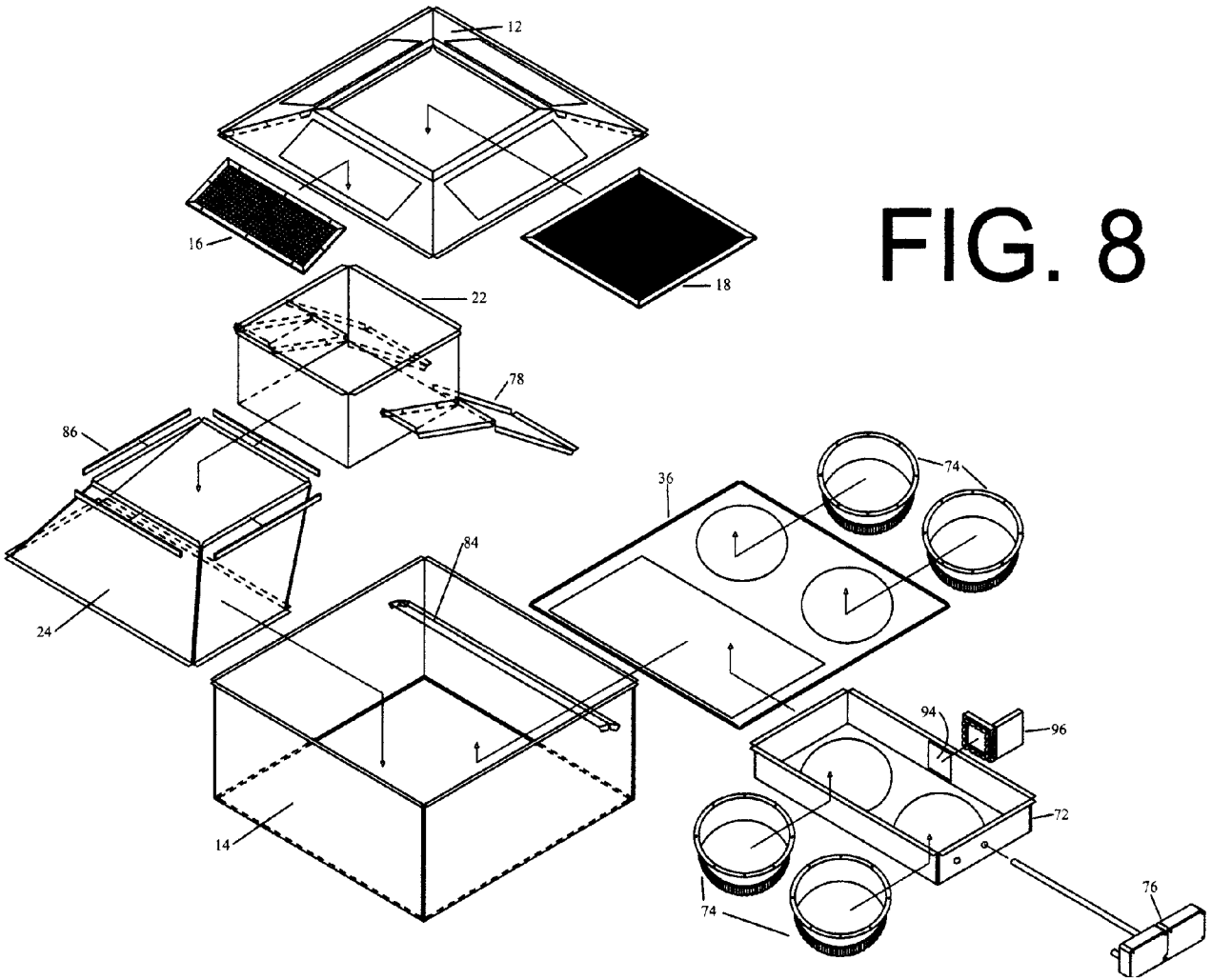
FIG. 8 is an exploded perspective view of an exemplary embodiment of the invention illustrating interior components.

FIG. 8 illustrates the addition of an access panel or access door (96) in an opening (94) of smoke pan (72). Accordingly a user or other person (e.g., installer or other person) can access sampling tube (90) by going through the access door (96). This is an improvement over embodiments where a plurality of access doors, ports, openings etc. must be traversed in order to access a sampling tube. For example in some embodiments not illustrated a user must also traverse an area containing return air (outgoing air) before accessing an area containing supply air (ingoing air) that is being sampled by an air sampling tube. As is shown in FIGS. 7*b* and 8, the sampling tube extends into the inner surround centrally aligned with the diameters of the collars and completely across both collars such that the sampling tube is subjected to a maximal air pressure within the inner surround. In the case of a rectangular collar (not shown but also described herein), the rectangle inherently includes a center point and the sampling tube can be centrally aligned with the center point.

It should be understood, of course, that the foregoing relates to exemplary embodiments of the invention and that modifications may be made without departing from the spirit and scope of the invention as set forth in the following claims.

What is claimed is:

1. A method for conveying air through a concentric air diffuser, the method comprising:

providing an inner surround structure that channels ingoing air of the concentric air diffuser, wherein the inner surround structure comprises a smoke pan and at least one collar attached to the smoke pan;

providing a central air diffuser to diffuse the ingoing air to the inner surround structure;

providing a smoke detector including a sampling tube;

providing an outer surround structure that channels outgoing air of the concentric air diffuser;

providing at least one supply air diffuser to diffuse the outgoing air to the outer surround structure; and mounting the smoke detector to the inner surround structure such that a sampling tube of the detector extends into the smoke pan and is centrally aligned with respect to the at least one collar and the sampling tube of the detector is accessible through a single sampling tube access door on the smoke pan, wherein the sampling tube access door is non permeable to air.

2. A method in accordance with claim 1 further comprising providing an R8 R-value insulator on the inner surround structure.

3. A method in accordance with claim 1 further comprising providing structure to balance air out air flow among the at least one supply air diffuser.

4. A method in accordance with claim 3 further comprising angling the at least one supply air diffuser at an angle not 90 degrees to the normal of an air inlet flow direction.

5. A method in accordance with claim 3 further comprising angling the at least one supply air diffuser at an angle about 27 degrees to the normal of an air inlet flow direction.

6. A method in accordance with claim 3 further comprising angling the at least one supply air diffuser at an angle about 25 degrees to the normal of an air inlet flow direction.

7. A method in accordance with claim 3 further comprising angling the at least one supply air diffuser at an angle between 15 degrees and 40 degrees to the normal of an air inlet flow direction.

8. A method in accordance with claim 1 wherein the inner surround structure comprises at least one collar having a diameter, and wherein the sampling tube extends into the smoke pan centrally aligned with the diameter of the at least one collar.

9. A method in accordance with claim 8 wherein the inner surround structure comprises at least two collars both having a diameter, and wherein the sampling tube extends into the smoke pan centrally aligned with the diameters of the at least two collars.

10. A method in accordance with claim 8 wherein the inner surround structure comprises at least two collars both having a diameter, and wherein the sampling tube extends into the inner surround centrally aligned with the diameters of the at least two collars and completely across both collars such that the sampling tube is subjected to a maximal air pressure within the smoke pan.

* * * * *